US006199706B1

(12) United States Patent
Shea

(10) Patent No.: US 6,199,706 B1
(45) **Date of Patent: *Mar. 13, 2001**

(54) MERCHANDISING DISPLAY STRUCTURE

(76) Inventor: Thomas M. Shea, 1407-C Allen Dr., Troy, MI (US) 48083

( * ) Notice: Subject to any disclaimer, the term of this patent is extended or adjusted under 35 U.S.C. 154(b) by 0 days.

This patent is subject to a terminal disclaimer.

(21) Appl. No.: 08/829,837

(22) Filed: Apr. 1, 1997

Related U.S. Application Data

(63) Continuation-in-part of application No. 08/599,407, filed on Nov. 26, 1995, now Pat. No. 5,660,286.

(51) Int. Cl.[7] ..... A47F 5/00

(52) U.S. Cl. ..... 211/87.01; 211/189; 211/103; 248/220.41; 248/220.42

(58) Field of Search ..... 211/87.01, 59.1, 211/103, 189, 175, 94.01; 248/220.21, 220.31, 220.41, 220.42, 218.4, 219.3

(56) References Cited

U.S. PATENT DOCUMENTS 5,505,319 * 4/1996 Todd ..... 211/95
5,657,884 * 8/1997 Zilincar ..... 211/59.1 X
5,660,286 * 8/1997 Shea ..... 211/87.01
5,678,702 * 10/1997 Menaged et al. ..... 211/87.01

* cited by examiner

*Primary Examiner*—Robert W. Gibson, Jr.
(74) *Attorney, Agent, or Firm*—Gifford, Krass, Groh, Sprinkle, Anderson & Citkowski, P.C.

(57) ABSTRACT

A merchandising display assembly mounted to a vertical support surface, the support surface having a number of spaced apart and apertured receiving portions formed therethrough. At least one horizontally extending member is mounted to and extends from the support surface. The horizontally extending member includes first and second telescoping and elongated portions and axially adjusting means for establishing an overall length between the elongated portions. An elongated display member is secured to an outer end of the second telescoping portion and extends in parallel fashion relative to the vertical support surface at a spaced distance. The axially adjusting means permit the display member to be adjusted to a desired spaced position relative to the vertical support surface and the display member is capable of supporting large volumes of small sized merchandise without obscuring additional merchandise located on the vertical support surface.

5 Claims, 4 Drawing Sheets

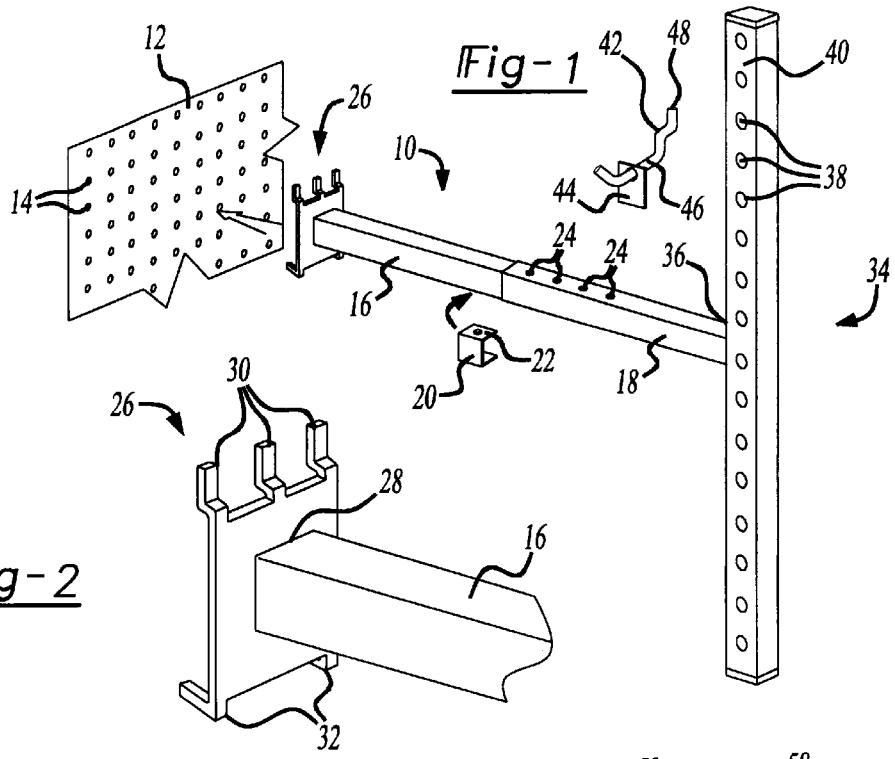
Fig-1
Fig-2
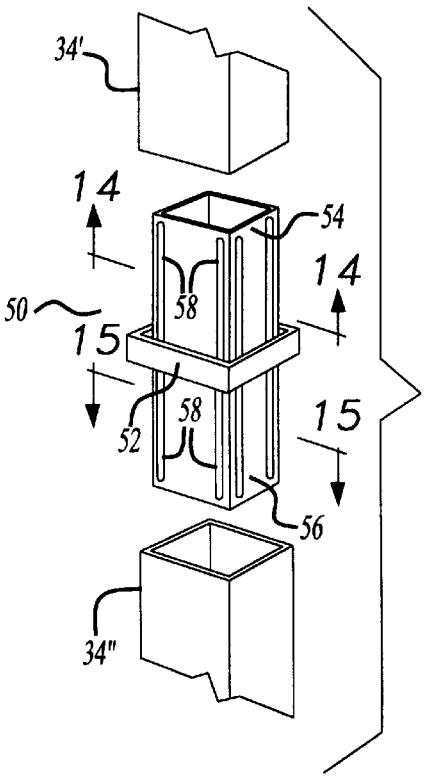
Fig-13
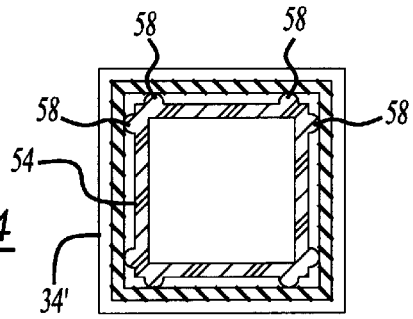
Fig-14
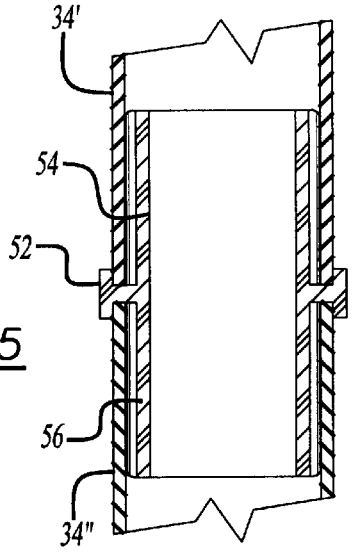
Fig-15

MERCHANDISING DISPLAY STRUCTURE

CROSS REFERENCE TO RELATED APPLICATIONS

The present application is a continuation-in-part of U.S. Ser. No. 08/599,407, filed Nov. 26, 1995 now U.S. Pat. No. 5,660,286, for a merchandising display structure.

BACKGROUND OF THE INVENTION

1. Field of the Invention

The present invention relates generally to merchandising display assemblies and, more particularly, to a merchandising display structure which is securable to a vertical support surface and which includes an elongated display member attached to one or more horizontally extending members and being spaced a distance from the vertical support, the display member being capable of supporting volumes of smaller sized merchandise.

2. Description of the Prior Art

Shelving structures and related display units for displaying merchandise are a common sight in any type of store or commercial establishment. The desire of any merchant is and always has been to maximize the available shelf or display capacity within the limited confines of the store. Vertically extending pegboard surfaces are particularly effective for displaying small, high volume merchandise on hooks and other horizontally extending fasteners.

Applicant's prior application, U.S. Ser. No. 08/599,407, filed Nov. 26, 1995, discloses a merchandising display assembly which may be mounted to a vertical support surface. The support surface in the preferred embodiment is a conventional pegboard surface having a number of apertures formed therethrough. First and second elongated arms are connected together in an axially adjustable manner and a planar support portion is attached to a first elongated arms and includes projecting fmger portions which engage within selected apertures in the pegboard support surface. An elongated display member is attached to a free end of the second elongated arm, upon which are mounted pluralities of hooks or other hangers for supporting volumes of small sized packaged merchandise.

U.S. Pat. No. 5,443,167, issued to Menaged et al., teaches a merchandising display system for a gondola merchandising display unit. The display assembly includes first and second integrally formed cantilever members which are interconnected by an otherwise free standing vertical member and the cantilever members are further capable of securing to an upright support member of the gondola display unit. The free standing vertical member is formed to include a plurality of apertures adapted to receive peg members for holding individual volumes of merchandise. While teaching a useful display system, Menaged does not permit for any range of telescoping or axial readjustment of the cantilever members or free standing vertical members to accommodate differing spacing requirements in an aisle or walkway.

U.S. Pat. No. 5,556,064, issued to Cowe, teaches a golf bag and accessory cradle which may be placed within a vehicle trunk and includes a base with a pair of vertically adjustable supports terminating in upwardly facing and rounded end brackets which conforms to the shape of a golf bag. Cowe does not however teach any form of vertically extending and engaging member for supporting volumes of merchandise.

U.S. Pat. No. 3,677,415, issued to Radek, teaches a cantilever merchandise support including an article supporting hanger bar or bracket which is adapted to be attached to a perforated board or panel by a plurality of legs extending from a mounting plate. The hanger bar or bracket portion is in each instance an integrally formed single piece which is mounted to extend outwardly from the vertical surface and upon which the merchandise is supported. The disadvantage of cantilevered merchandise supports such as those taught by Radek is that their merchandise carrying capacity is limited to the bar or bracket portion. The axial length which such supports extend is likewise limited such that they are unable to utilize to any great extent the air space extending from the pegboard or other surface for displaying merchandise.

U.S. Pat. No. 5,014,954, issued to Merl, discloses an adjustable display arm assembly securable to a vertical support structure which includes a pair of nesting segments selectively adjustable at longitudinal positions to establish an overall length of the display arm. The Merl device is somewhat of an improvement over Radek in that the display arm can be extended outward a greater horizontal distance, however its merchandise carrying ability is still limited to the display arm itself and it does not include any additional bracketry for carrying large volumes of merchandise.

SUMMARY OF THE PRESENT INVENTION

The present invention is an improved and telescopable merchandising display assembly which may be mounted to a vertical mounting surface, the support surface being in the preferred embodiment either a conventional pegboard surface, a slat wall surface or a form of a slotted upright surface. At least one horizontally extending arm is provided and includes first and second elongated portions which are axially adjustable and preferably tubular shaped and telescopingly mounted to permit a user to modify an overall length of the arm. A support surface engaging portion is attached to a free end of the first elongated portion and is engaged within a selected one of the vertical mounting surfaces to mount the arm in a horizontally extending fashion relative the vertical surface.

An elongated display member is attached to a free end of the at least one second elongated portion and extends parallel and at a spaced distance from the vertical support surface. A plurality of apertures are formed along the length of the display member at spaced apart intervals which are designed to receive hooks or other conventional hangers for supporting large volumes of small sized packaged merchandise. The advantage of the display member is that it can support small, high volume merchandise a spaced distance from the pegboard or other vertical surface without obscuring other additional items displayed on the vertical board or shelf surface. The overall advantage of the present invention is that it greatly increases the merchandise display capacity of such a conventional display structure by utilizing to a much greater extent the unused air space in the area in front of the display surface.

In further preferred embodiments, a pair of horizontally extending members may be provided which are separately attached to and which extend in parallel fashion from the display surface. The members attach to a display member extending therebetween at corresponding outer ends. The display arm supported by two horizontal members may be longer in length to accommodate additional product and may be arranged to extend in either a horizontal or vertical fashion as desired. The display arm may also itself be formed as two or more telescoping portions to either reduce or increase its overall length and a spring clip fastener may likewise be utilized with apertures formed in the sections to establish a given display arm length.

BRIEF DESCRIPTION OF THE DRAWING

Reference will now be made to the attached drawing, when read in combination with the following description of the preferred embodiments, wherein like reference numerals refer to like parts throughout the several views, and in which:

FIG. 1 is a perspective view of a merchandising display assembly according to a first preferred embodiment of the present invention;

FIG. 2 is a sectional view of a support surface engaging portion for securing to a vertical mounting surface according to the preferred embodiment of the present invention set forth in FIG. 1;

FIG. 13 is an exploded view of an intermediate coupling member for securing together first and second elongated display members according to the present invention;

FIG. 14 is a cutaway view taken along line 14—14 of FIG. 13 and illustrating a first cross sectional view of the coupling member and a first of the elongated display members according to the present invention; and FIG. 15 is a cutaway view taken along line 15—15 of FIG. 13 and illustrating a second cross sectional view of the coupling member and first and second elongated display members according to the present invention.

DETAILED DESCRIPTION OF THE PREFERRED EMBODIMENTS

Figure 3:
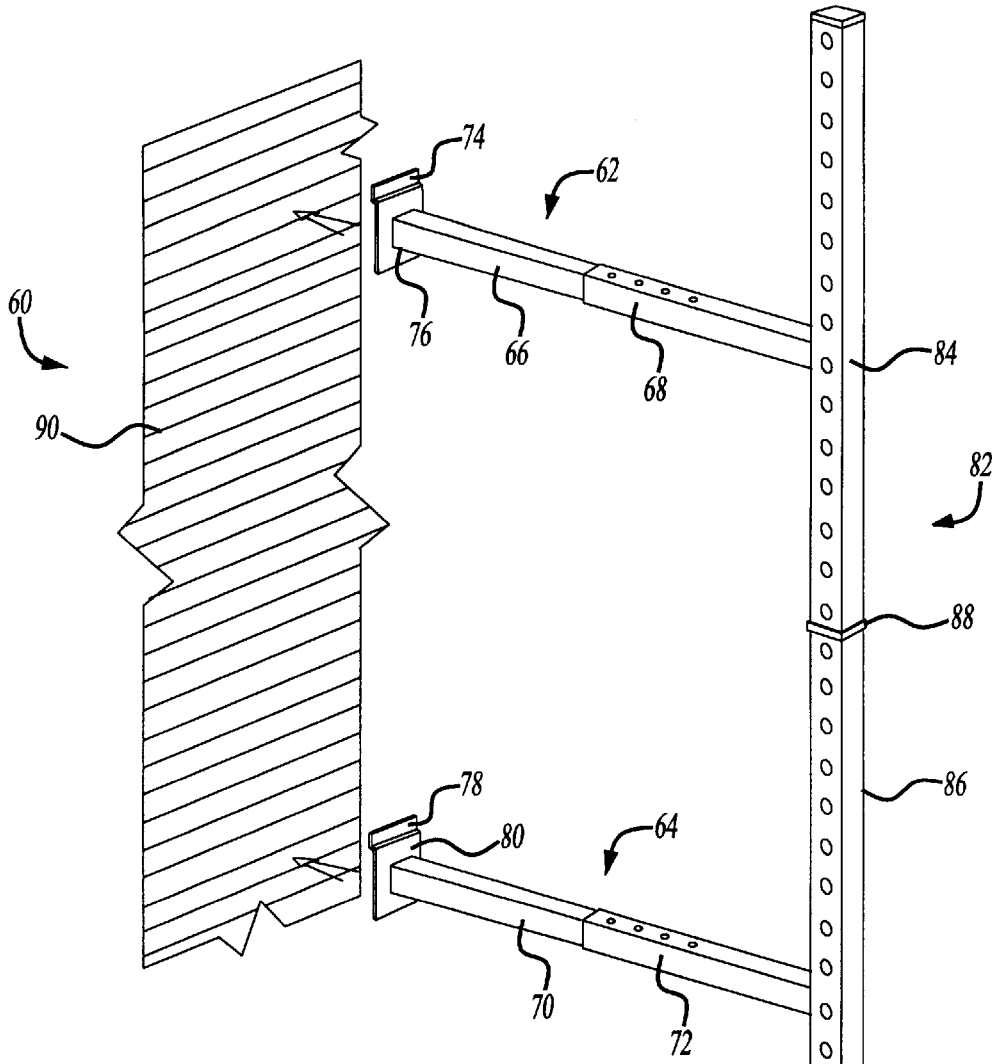
FIG. 3 is a perspective view of a merchandising display assembly according to a further preferred embodiment of the present invention.

Referring now to FIG. 1, a merchandising display assembly 10 is shown secured to a vertical mounting surface 12 having a number of apertures 14 according to a first preferred embodiment. The vertical mounting surface 12 utilized with the first preferred embodiment is typically a holed pegboard type surface upon which volumes of small merchandise are displayed using hooks or hangers.

The merchandising display assembly 10 includes a first horizontally extending member with a first polygonal shaped and telescopically extending portion 16 and a second polygonal shaped and telescopically extending portion 18. The first telescopically extending portion 16 extends from the vertical mounting surface 12 and is constructed of a first hollowed member which is polygonal shape in cross section. The second telescopically extending portion 18 is axially repositionally adjustable relative to the first extending portion 16 and is likewise constructed of a second hollowed member which is polygonal shaped in cross section. The first and second telescopically extending portions 16 and 18 are preferably each tubular shaped in section and are further constructed of a lightweight and durable metal. Preferably, the telescoping portions 16 and 18 are rectangular in section as is illustrated, however it is understood that any other polygonal shaped member can be used ranging from a triangle to a circle which is defined as a polygon having an infinite number of sides.

As is best shown in FIG. 1, the first telescoping portion 16 is releasably and slidably engaged within the second telescoping portion 18 by a spring biased clip 20. The clip 20 is mounted within the hollowed interior of the second tubular portion 18 and includes a substantially hybrid combination of "V" and "U" shaped bodies with an upwardly facing button portion 22 which, upon mounting the clip 20 within the open interior of the telescoping portions, projects through a selected one of a plurality of apertures 24. Although not clearly shown, both the first and second telescoping portions 16 and 18 have overlapping apertures which, upon alignment, permit the button portion 22 to biasingly engage upwardly and releasably lock the first and second telescoping portions in a selected axially adjusted position.

A support surface engaging portion 26 according to the first preferred embodiment is in the shape of a planar body member and is connected to a free end 28 of the first telescoping portion 16, preferably by welding. The planar shaped engaging portion 26 includes a first plurality of "L" shaped members 30 extending along an upper edge at spaced apart intervals and a second plurality of rearwardly projecting fingers 32 extending at spaced intervals along a lower edge of the planar engaging portion 26. The support surface engaging portion 26 of FIG. 1 preferably includes three upper "L" shaped members 30 and a pair of lower rearwardly projecting fingers 32, however either more or fewer of the members 30 and projecting fingers 32 may be employed without departing from the scope of the invention.

The support surface engaging portion 26 is capable of quickly and effectively mounting the display assembly to the vertical support surface by first inserting the upwardly projecting ends of the "L" shaped fingers 30 and 32 into a selected row of horizontal apertures 14 and then rotating the engaging portion downwardly so that the L-shaped fingers fixedly engage within the apertures 14 and the lower pair of projecting fingers 32 are likewise received within additional apertures 14 in a lower selected row on the mounting surface 12 and the display assembly is releasably engaged in a substantially horizonal arrangement. In the case of two horizontally extending members, as is shown in the further preferred embodiment of FIG. 3, it is understood that one of the pairs of elongated tubular shaped portions would have to be disassembled and subsequently reassembled in order to mount the second of the support surface engaging portions at a position relative to the first of the support surface engaging portions.

An elongated display member 34 is likewise constructed of a durable and resilient material and is preferably of a similar shape and cross section to the first and second tubular shaped and horizontally extending portions 16 and 18. The elongated display member 34 is secured at a midpoint to a free end 36 of the tubular elongated portion 18 so that the display member 34 extends in opposite and perpendicular fashion relative to the first and second telescoping portions and in a spaced apart and parallel fashion with respect to the vertical mounting surface 12. A large plurality of apertures 38 are formed at small increments along a face 40 of the display member 34 and are each capable of receiving thereupon an appropriately configured hanger 42. Volumes of smaller sized items of merchandise 44 may be suspended from a laterally outwardly extending stem 46 of each of the hanger portions 42 once an attaching portion 48 has been engaged through a selected aperture 38.

Preferably, an additional plurality of apertures are formed along a face opposite the face 40 of the display member (not shown) and are capable of supporting additional volumes of merchandise 44 in a spaced and parallel fashion relative to the vertical support surface.

Referring to FIGS. 13–15, a coupling assembly is illustrated for securing a first elongated display member 34' to a second elongated display member 34". As was described in preceding application Ser. No. 08/599,407, the elongated display member 34 may be provided as two or more individual sections which are assembled together to define a desired parallel extending length in a spaced fashion from the vertical mounting surface. A coupling member 50 is provided as the intermediate engaging means and includes a body with a central shoulder portion 52, a first extending and inserting portion 54 and a second oppositely extending and inserting portion 56. The coupling member 50 is preferably shaped rectangular in cross section to accommodate the sections of the elongate display member, with the first extending and inserting portion 54 being received within an open end of the first display member section 34' and the second extending and inserting portion 56 being received within an open end of the second display member section 34".

Referring to FIG. 14, a cutaway view is shown of the first inserting portion 54 seating within the open end of the first display member 34'. A plurality of longitudinally extending and projecting guide surfaces 58 are provided in pairs located along the outer edges on each of the rectangular faces which define the first and second inserting portions 54 and 56. As is best illustrated in the cross section of FIG. 14, the projecting guide surfaces 58 provide abutting contact with the interior of the display member 34' and establish a frictional engagement with the display member 34'.

Referring to FIG. 15, the abutting engagement of the opposing edges of the display members 34' and 34" is shown against the corresponding upper and lower ledges of the central shoulder portion 52. In combination, FIGS. 14 and 15 illustrate the cooperating engagement of the display member sections 34' and 34" with the intermediate coupling member 50 which permits a user to add to the overall length of a display member such as that illustrated at 34 in FIG. 1 or any other display member as will be subsequently described in this specification.

Referring to FIG. 3, a further variant 60 of the merchandising display assembly is shown and includes a first horizontally extending member 62 and a second spaced apart and horizontally extending member 64, the first member 62 including first and second telescopically extending portions 66 and 68 and the second member 64 including first and second telescopically extending portions 70 and 72. A first support surface engaging portion 74 is attached to a free end 76 of the first elongated portion 66 of the first horizontally extending member 62 and a second support surface engaging portion 78 is attached to a free end 80 of the second elongated portion 70.

An elongated display member 82 is provided and is constructed of a first upper tubular section 84 connected to a remote end of the first horizontally extending member 62 and a second lower tubular section 86 connected to a remote end of the second horizontally extending member 64. A coupling member 88 connects the tubular sections 84 and 86 together to combine the individual display assembly provided by the horizontal member 62 and display member 84 and the horizontal member 64 and display member 86 into the overall assembly 60. Additional coupling members are envisioned which could add either additional display members to either end of the member 82, such additional display members possibly also having horizontally extending arms to provide additional stability to the assembly.

Figure 4:
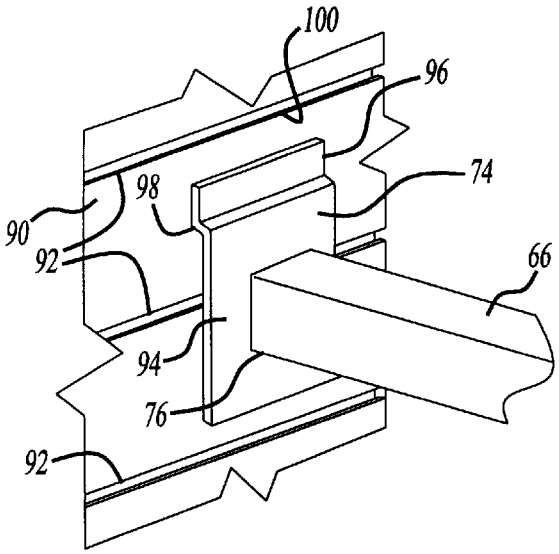
FIG. 4 is a sectional view of a support surface engaging portion for securing to a vertical mounting surface according to the preferred embodiment of the present invention set forth in FIG. 3.

Referring to FIG. 4, an enlarged sectional view is shown of the first support surface engaging portion 74 according to the further preferred embodiment for engaging with a vertical mounting surface 90. The mounting surface 90 is a slat wall which includes a substantially flat planar face defined by a plurality of spaced apart and horizontally extending recessed channels 92. The support surface engaging portion 74 includes a first substantially planar shaped portion 94 and a second continuous and substantially "L" shaped engaging portion 96 which extends along an upper edge of the planar shaped portion 94.

To install the support surface engaging portion 74 within the vertical mounting surface 90, the engaging portion 74 is first positioned in an angular relationship relative to a selected channel 92. The upper edge of the "L" shaped engaging portion 96 is then inserted within the selected channel 92 in an upward fashion and the planar shaped portion 94 is then rotated downwardly whereupon a lower projecting edge 98 established between the "L" shaped engaging portion 96 and the planar shaped portion 94 abuts against a lower wall 100 of the selected channel 92 to lock the engaging portion 74 in place. As was previously described, it is necessary to separately attach the individual support surface engaging portions 74 and 78 to the vertical mounting surface 90 prior to interconnecting the display members 84 and 86.

Figure 5:
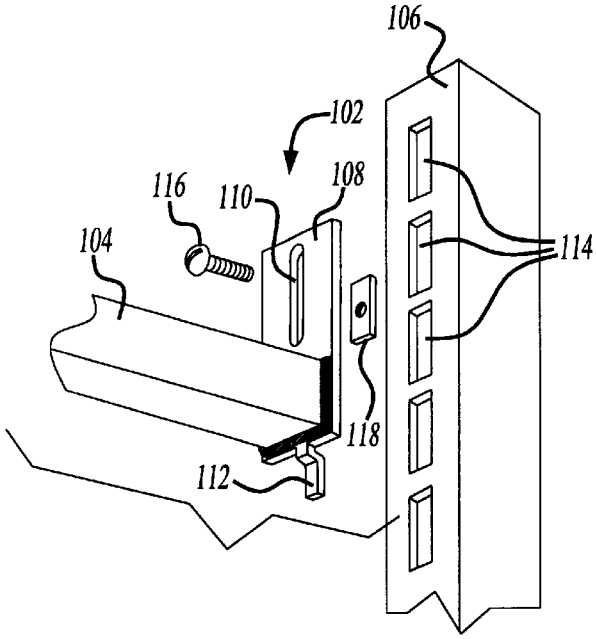
FIG. 5 is a partially exploded view of a support surface engaging portion of a telescoping display assembly according to a further preferred embodiment of the present invention.

Referring to FIG. 5, a support surface engaging portion 102 is shown in fragmentary view attached to a portion 104 of a tubular shaped telescoping portion according to a further preferred embodiment of the present invention. The engaging portion 102 attaches to a vertical mounting surface 106 of the vertical engaging support and includes a plate shaped portion 108 which is secured to an edge of the tubular shaped telescoping portion 104 and extends upwardly. A vertical slotted portion 110 extends along the upwardly extending part of the planar shaped portion 108 and a downwardly and forwardly stepped portion 112 extends from a corresponding bottom edge. The vertical mounting surface 106 includes a plurality of individual and spaced apart slot shaped receiving apertures 114 which extend vertically along the length of the mounting surface 106 and the mounting surface is conventionally provided as a vertically extending post of a shelving unit display.

Figure 6:
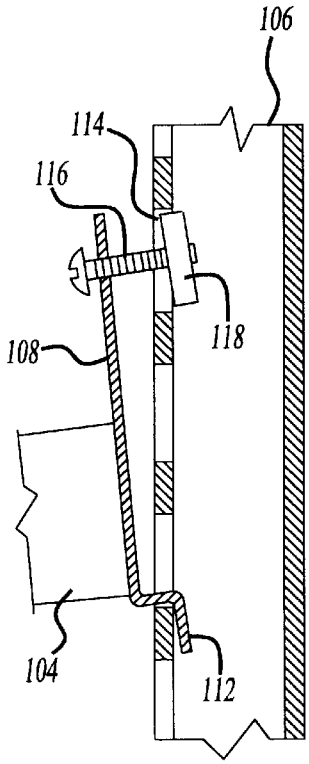
FIG. 6 is a first installation view of the support surface engaging portion of FIG. 5 illustrated in cutaway and showing a first insertion step according to the further preferred embodiment of the present invention.
Figure 7:
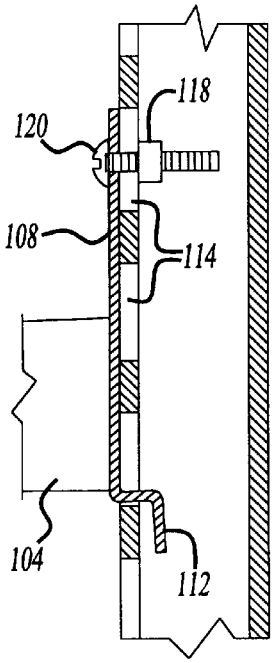
FIG. 7 is a second installation view of the support surface engaging portion of FIG. 5 illustrated in cutaway and showing a second tightening step according to further preferred embodiment of the present invention.

Referring to FIGS. 6 and 7, the installation steps of the engaging portion 102 are illustrated. The engaging portion 102 is first positioned in an angular relationship relative to the vertical mounting surface 106 so that the downwardly and forward stepped portion 112 is positioned within a first selected aperture 114. A forwardly extending and threaded shaft of a screw 116 is then inserted through the vertical slotted portion 110 and a square shaped nut 118 with an internally threaded aperture is attached to an end of the shaft projecting beyond the plate shaped portion 108. The engaging portion 102 is then rotated upwardly so that the nut 118 passes through the selected aperture 114 and is inserted within the hollow interior of the vertical mounting surface 106.

Referring again to FIG. 7, the engaging portion 102 is rotated to a substantially vertical position whereupon the a head portion 120 of the screw 116 is tightened to in turn cause the square shaped nut 118 to rotate ninety degrees so that it is no longer positioned in alignment with the selected aperture 114 and so that it will forcibly abut against a rear of the vertical mounting surface 106 upon further and completed tightening of the screw. At this point, the downwardly and forwardly stepped portion 112 is fixedly seated upon an upwardly facing surface of a lower selected aperture 114 and the horizontally extending arm assembly and elongated display member assembly which corresponds to the support surface engaging portion 102 extends in a spaced manner from the vertical mounting surface 106.

Figure 8:
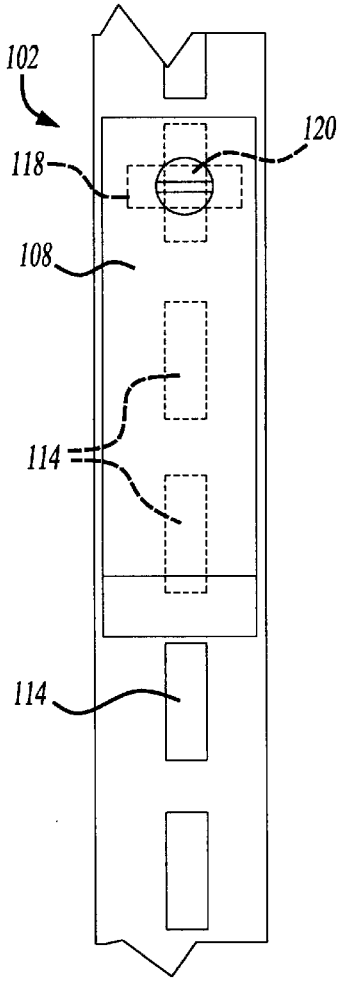
FIG. 8 is a view in cross section of the support surface engaging portion as substantially illustrated in FIG. 7 in a mounted position relative to the vertical mounting surface.
Figure 9:
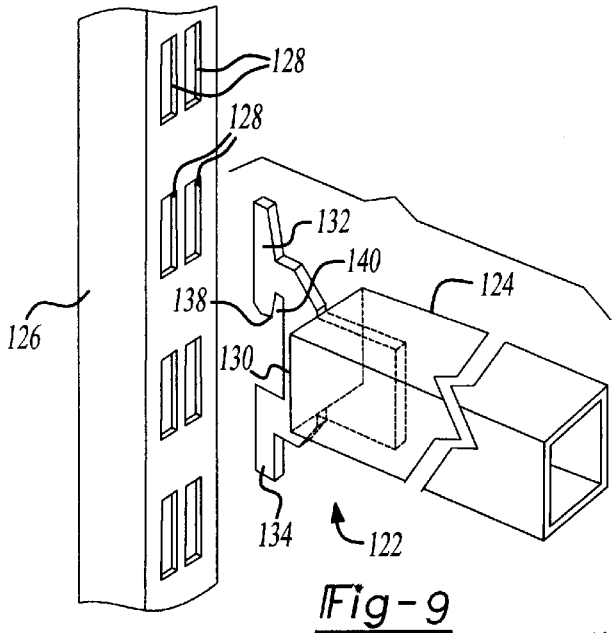
FIG. 9 is a view of a support surface engaging portion of a telescoping display assembly according to a further preferred embodiment of the present invention.

Referring to FIG. 8, a cross sectional view of the engaging portion 102 is shown in partial phantom and further illustrates the square shaped nut 118 rotated in its approximately ninety degree offset position relative to the selected aperture 114 and abutting against the inside surface of the vertically extending support 106. The combination of the screw 116 and square nut 118 at the upper end of the plate 108 and the downwardly and outwardly stepped portion 112 at it corresponding lower end firmly engages the display assembly in place and is sufficient for supporting the weight exerted by pluralities of merchandise supported upon a remote extending display member (not shown).

Referring finally to FIGS. 9–12, a still further preferred embodiment of a support surface engaging portion 122 is shown for installing a merchandising display assembly (illustrated by partial view 124 of a first tubular shaped and telescoping portion) to a vertical mounting surface 126. The mounting surface 126 is similar to that illustrated in the embodiment of FIGS. 5–8, with the exception of pairs 128 of spaced apart apertures which extend in generally vertical fashion along the forward face of the vertical support surface 126

The support surface engaging portion 122 includes an end bracket 130 which secures within an open end of the tubular engaging portion 124. The engaging portion 122 includes a first forwardly spaced and upwardly projecting member 132 and a second forwardly spaced and downwardly projecting member 134. The upwardly and downwardly projecting members 132 and 134 are arranged in generally planar fashion so that they engage first and second vertically spaced apertures 128 as will now be described.

Figure 11:
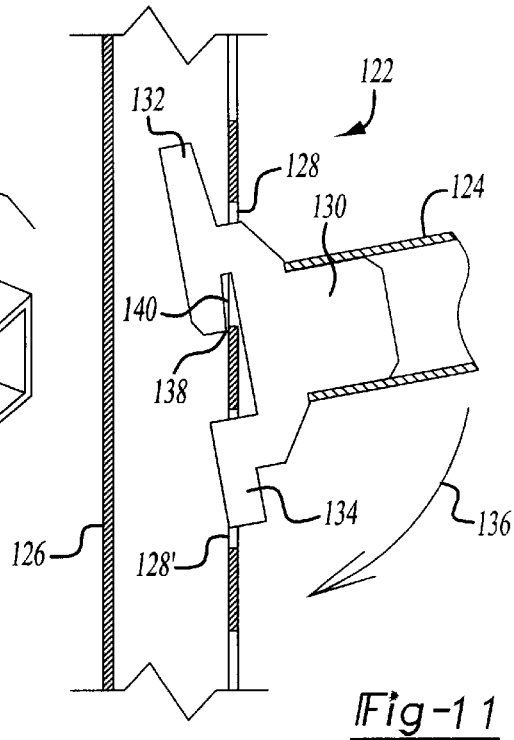
FIG. 11 is a second installation view of the support surface engaging portion of FIG. 9 and showing a second downwardly rotating step of the further preferred embodiment of the present invention.
Figure 10:
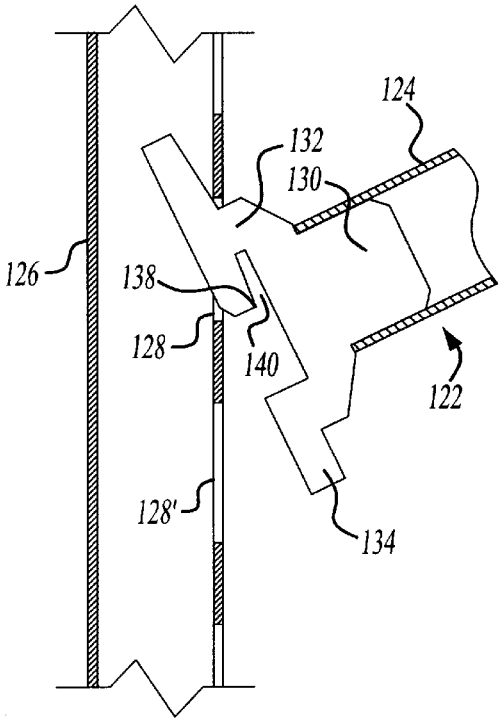
FIG. 10 is a first installation view of the support surface engaging portion of FIG. 9 illustrated in cutaway and showing a first insertion step of the further preferred embodiment of the present invention.

Referring again to FIGS. 10–12 in sequence, an explanation of the manner of attaching the support surface engaging portion 122 within first and second selected apertures 128 and 128' of the vertical support 126 will now be made and includes first positioning the engaging portion 122 in an angular relationship relative to the vertical support 126 so that a majority of the forwardly and upwardly projecting member 132 is inserted through the first selected aperture 128 and within the hollow interior of the vertical support 126 as shown in FIG. 10. In a subsequent inserting step as illustrated in FIG. 11, the support surface engaging portion 122 is subsequently rotated downwardly in a direction illustrated by arrow 136 so that the forwardly stepped and downwardly projecting member 134 begins to seat through the further selected lower aperture 128' and so that an inner recessed edge 138 of the upwardly projecting member 132 aligns with a corresponding upwardly facing edge of the upper aperture 128.

Figure 12:
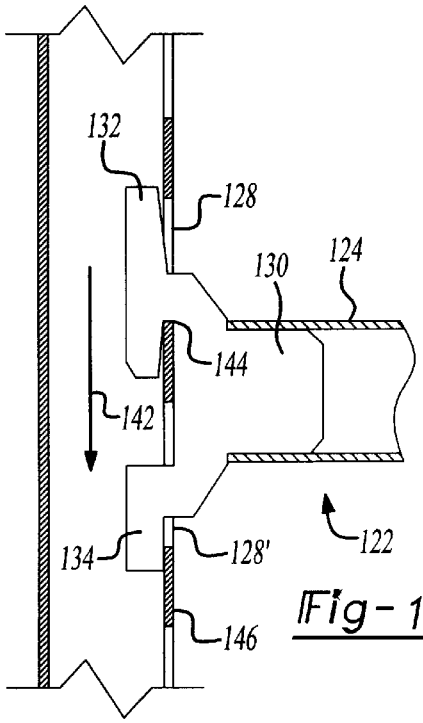
FIG. 12 is a third installation view of the support surface engaging portion of FIG. 9 and showing a third engaged step of the further preferred embodiment of the present invention.

An upwardly vertically extending and recessed channel 140 extends from along the inner recessed edge 138 of the upwardly projecting member 132 and, as is further illustrated in FIG. 12, permits the upper and lower projecting members 132 and 134 of the support surface engaging portion 122 to downwardly seat within the associated apertures 128 and 128' in the direction of downwardly extending arrow 142. As is best shown in the cutaway of FIG. 12, the portion of the vertical support 126 forming the upwardly facing boundary of the aperture 128, and illustrated at 144, receives the recessed channel 140 of the upwardly projecting member 132 in a downwardly sliding fashion as does a like portion 146 of the aperture 128' boundary slidingly receive and abut against a rear vertical surface of the downwardly extending and forwardly projecting member 146. In this fashion, the further preferred embodiment 122 of the support surface engaging portion mounts a merchandising display assembly as described in the present invention in a mounted and spatial arrangement relative to the vertical support 126.

The present invention therefore provides a merchandise display assembly which utilizes existing vertical shelving displays and the air space in front of the displays, such as a pegboard surface, slat wall surface or slotted upright surface for displaying significantly larger volumes of merchandise at little extra cost to the merchant.

It is further understood that the preceding discussion covers only the most preferred embodiments of the merchandising display assembly according to the present invention and that other shapes and designs may also be employed. Specifically, more than two horizontally extending members may be employed with one or more vertically or horizontally extending display members in connected fashion as previously described. Other types of affixing means may also be utilized in the support portions for mounting them to the vertically extending surface. Finally, the merchandise display assembly according to the present invention is capable of being used with just about any vertically extending surface aside from those previously described which is appropriately configured for receiving the support surface engaging portion utilized.

Having described my invention, other additional embodiments will become apparent to those skilled in the art to which it pertains according to the appended claims:

I claim:

1. A merchandising display assembly for mounting to a vertical mounting surface, the mounting surface being a surface having a plurality of individual and spaced apart apertures, said display assembly comprising:

at least one horizontally extending member including a first elongated and polygonal shaped portion and a second elongated and polygonal shaped portion, said first and second elongated portions being telescopically connected and capable of being adjustable in an inwardly and outwardly axial fashion to space said second elongated portion relative to said first elongated portion and to define an overall length of said at least one horizontally extending member;

a support surface engaging portion attaching to a free end of said first elongated portion, said engaging portion including mounting means which engage with the apertured receiving portions in the vertical mounting surface to mount said horizontally extending member in an extending fashion from said support surface, said mounting means of said support surface engaging portion further comprising a planar shaped body with a first plurality of "L" shaped members extending from along an upper edge of said planar shaped body a second plurality of spaced apart and rearwardly projecting fingers extending from along a lower edge of said planar shaped body, said plurality of "L" shaped members seating within a first selected plurality of the apertures and said rearwardly projecting fingers seating within a second selected plurality of the apertures upon said planar shaped body being rotated downwardly to a substantially vertical position; and an elongated display member which is mounted at a midpoint thereof to a free end of said second elongated portion of said at least one horizontally extending member, said display member extending oppositely and in perpendicular fashion relative to said horizontally extending member and at a spaced distance from the vertical mounting surface, said display member including receiving means at spaced intervals along said display member for receiving volumes of merchandise.

2. A merchandising display assembly for mounting to a vertical mounting surface, the mounting surface being a slat wall surface with a plurality of spaced apart and horizontally extending recessed channels, said display assembly comprising:

at least one horizontally extending member including a first elongated and polygonal shaped portion and a second elongated and polygonal shaped portion, said first and second elongated portions being telescopically connected and capable of being adjustable in an inwardly and outwardly axial fashion to space said second elongated portion relative to said first elongated portion and to define an overall length of said at least one horizontally extending member;

a support surface engaging portion attaching to a free end of said first elongated portion, said engaging portion including mounting means which engage with the apertured receiving portions in the vertical mounting surface to mount said horizontally extending member in an extending fashion from said support surface, said mounting means of said support surface engaging portion further comprising a first substantially planar shaped portion and a second continuous and substantially "L" shaped engaging portion extending along an upper edge of said first planar shaped portion, said "L" shaped engaging portion seating within a selected recessed channel of the slat wall surface and said planar shaped portion being rotated downwardly to engage said "L" shaped portion within the associated channel; and an elongated display member which is mounted at a midpoint thereof to a free end of said second elongated portion of said at least one horizontally extending member, said display member extending oppositely and in perpendicular fashion relative to said horizontally extending member and at a spaced distance from the vertical mounting surface, said display member including receiving means at spaced intervals along said display member for receiving volumes of merchandise.

3. A merchandising display assembly for mounting to a vertical mounting surface, the vertical mounting surface being a post with a substantially rectangular cross sectional shape and at least one plurality of individual and slot shaped receiving apertures being arranged vertically and in spaced apart fashion, said display assembly comprising:

at least one horizontally extending member including a first elongated and polygonal shaped portion and a second elongated and polygonal shaped portion, said first and second elongated portions being telescopically connected and capable of being adjustable in an inwardly and outwardly axial fashion to space said second elongated portion relative to said first elongated portion and to define an overall length of said at least one horizontally extending member;

a support surface engaging portion attaching to a free end of said first elongated portion, said engaging portion including mounting means which engage with the apertured receiving portions in the vertical mounting surface to mount said horizontally extending member in an extending fashion from said support surface, said mounting means of said support surface engaging portion further comprising a plate shaped portion, a vertical slotted portion extending upwardly along said plate shaped portion and a forwardly and downwardly extending stepped portion, said forwardly and downwardly extending stepped portion being seated within a first selected slotted aperture, a fastener inserting through said vertical slotted portion and engaging a square shaped nut which is seated within a second selected slotted aperture upon upward rotation of said plate shaped portion and said fastener being tightened to rotate said nut and to cause said nut to abut against an inwardly facing surface of the vertical mounting post; and an elongated display member which is mounted at a midpoint thereof to a free end of said second elongated portion of said at least one horizontally extending member, said display member extending oppositely and in perpendicular fashion relative to said horizontally extending member and at a spaced distance from the vertical mounting surface, said display member including receiving means at spaced intervals along said display member for receiving volumes of merchandise.

4. A merchandising display assembly for mounting to a vertical mounting surface, the vertical mounting surface being a post with a substantially rectangular cross sectional shape and at least one plurality of individual and slot shaped receiving apertures being arranged vertically and in spaced apart fashion, said display assembly comprising:

at least one horizontally extending member including a first elongated and polygonal shaped portion and a second elongated and polygonal shaped portion, said first and second elongated portions being telescopically connected and capable of being adjustable in an inwardly and outwardly axial fashion to space said second elongated portion relative to said first elongated portion and to define an overall length of said at least one horizontally extending member;

a support surface engaging portion attaching to a free end of said first elongated portion, said engaging portion including mounting means which engage with the apertured receiving portions in the vertical mounting surface to mount said horizontally extending member in an extending fashion from said support surface, said mounting means of said support surface engaging portion further comprising an end bracket, a first forwardly spaced and upwardly projecting member and a second forwardly spaced and downwardly projecting member, said first upwardly projecting member seating within a first selected and slotted aperture, said end bracket being rotated downwardly so that said second downwardly projecting member is seated within a second selected and slotted aperture and said bracket translating in a downward and vertical direction to lock said end bracket in place; and an elongated display member which is mounted at a midpoint thereof to a free end of said second elongated portion of said at least one horizontally extending member, said display member extending oppositely and in perpendicular fashion relative to said horizontally extending member and at a spaced distance from the vertical mounting surface, said display member including receiving means at spaced intervals along said display member for receiving volumes of merchandise.

5. A merchandising display assembly for mounting to a vertical mounting surface, the mounting surface having a number of spaced apart and apertured receiving portions formed therein, said display assembly comprising:

at least one horizontally extending member including a first elongated and polygonal shaped portion and a second elongated and polygonal shaped portion, said first and second elongated portions being telescopically connected and capable of being adjustable in an inwardly and outwardly axial fashion to space said second elongated portion relative to said first elongated portion and to define an overall length of said at least one horizontally extending member;

a support surface engaging portion attaching to a free end of said first elongated portion, said engaging portion including mounting means which engage with the apertured receiving portions in the vertical mounting surface to mount said horizontally extending member in an extending fashion from said support surface; and an elongated display member which is mounted at a midpoint thereof to a free end of said second elongated portion of said at least one horizontally extending member, said display member extending oppositely and in perpendicular fashion relative to said horizontally extending member and at a spaced distance from the vertical mounting surface, said display member including receiving means at spaced intervals along said display member for receiving volumes of merchandise, said elongated display member being polygonal shaped in cross section and further comprising a first attachable section and a second attachable section, an intermediate coupling member being inserted within selected and oppositely facing ends of said first and second sections to join said attachable sections together in end-to-end fashion.

* * * * *